US006203075B1

(12) United States Patent
Wells, Jr. et al.

(10) Patent No.: US 6,203,075 B1
(45) Date of Patent: Mar. 20, 2001

(54) FRONT OPENING CONTAINER LATCH

(75) Inventors: Robert L. Wells, Jr., Thetford Center, VT (US); James S. Hardigg, Conway, MA (US); David B. Neal, Florence, MA (US); Mark C. Gaydos, Greenfield, MA (US)

(73) Assignee: Hardigg Industries, Inc., South Deerfield, MA (US)

( * ) Notice: Subject to any disclaimer, the term of this patent is extended or adjusted under 35 U.S.C. 154(b) by 0 days.

(21) Appl. No.: 09/082,991

(22) Filed: May 22, 1998

(51) Int. Cl.[7] ..... E05C 19/10

(52) U.S. Cl. ..... 292/113; 292/95; 292/97; 292/100

(58) Field of Search ..... 292/113, 97, 100, 292/247, DIG. 49, DIG. 30, 249, 66, 129, 98, DIG. 11, 8, 109, DIG. 42; 220/326

(56) References Cited

U.S. PATENT DOCUMENTS

| | | | | |
|---|---|---|---|---|
| 1,698,916 | * | 1/1929 | Kocher | 292/113 |
| 1,768,188 | * | 6/1930 | Champion, Jr. | 292/8 |
| 2,547,183 | | 4/1951 | Verheyden et al. . | |
| 2,593,971 | | 4/1952 | Brandt | 292/128 |
| 2,743,029 | | 4/1956 | Mautner | 217/56 |
| 2,800,346 | * | 7/1957 | Manning | 292/113 |
| 3,257,157 | | 6/1966 | Jay | 312/328 |
| 3,602,723 | * | 8/1971 | Swanson | 292/113 |
| 3,706,467 | * | 12/1972 | Martin | 292/111 |
| 3,811,747 | | 5/1974 | Levin | 312/308 |
| 3,848,912 | * | 11/1974 | Jensen et al. | 292/256.5 |
| 4,128,233 | | 12/1978 | Eysn et al. | 266/243 |
| 4,284,202 | | 8/1981 | Barstow, Jr. | 220/4 B |
| 4,763,935 | * | 8/1988 | Bisbing | 292/66 |
| 4,791,801 | * | 12/1988 | Kramer et al. | 72/387 |
| 4,830,530 | * | 5/1989 | Meineke | 403/12 |
| 4,858,970 | * | 8/1989 | Tedesco et al. | 292/113 |
| 4,915,913 | | 4/1990 | Williams et al. | 422/119 |
| 5,461,892 | * | 10/1995 | Hsieh | 70/73 |
| 5,667,258 | * | 9/1997 | Takimoto | 292/113 |
| 5,732,987 | * | 3/1998 | Wright et al. | 292/113 |

* cited by examiner

*Primary Examiner*—Teri Pham Luu
(74) *Attorney, Agent, or Firm*—McCormick, Paulding & Huber LLP

(57) ABSTRACT

A latch is disclosed incorporating features allowing complete actuation i.e., engagement and disengagement of a latching hook on the side of the container from a latch handle on the face of the container thus allowing actuation of the latch hook even when the latch hook is itself inaccessible. The latch also features variability in the stroke of the hook and a design allowing its construction from plastic material.

14 Claims, 12 Drawing Sheets

FRONT OPENING CONTAINER LATCH

BACKGROUND OF THE INVENTION

1. Field of the Invention

The invention relates to latches. More particularly, the invention relates to latches which are engageable and disengageable from an easily accessible area to an otherwise inaccessible area such as when a latch is actuatable from a front of a container and the latch hook is on the side of the container, the side of the container being obscured by other containers.

2. Prior Art

In the ensuing discussion the types of latches described are generally referred to as front opening latches since the first surface perceived by a user is considered to be the "front" of the container. In the discussion of the prior art hereunder and in the discussion of the invention, the term "front" is used generically to indicate the exposed surface of the container. This could actually be, however, any surface of the container.

Front opening latches of the prior art have been developed for the same purpose as the present invention; that is to allow operation of the latch where containers are stacked next to one another obstructing access to the sides of the container. Since other conventional latches reside on the side of the container or require movement out of the plane of the side of the container, operation of these would be severely impeded.

Two main categories of prior art latches are intended to satisfy the desire/requirement for front operation latches. These are 1) side mounted latches that are operable when access to box sides is limited and 2) top mounted latches.

In the first category (side mounted), an example of an arguably "front only" actuatable latch is known by the trade name "Hook Lock" and is illustrated in FIG. 1 of this application. One of skill in the art will recognize this latch. The latch incorporates a cam design so that movement of the handle lever causes both an arcuate and a radial movement of the hook. Thus, upon moving the handle lever in the appropriate direction the hook moves into engagement with the keeper plate. Further movement of the lever in the same direction causes the hook to draw the keeper plate toward the cam of the handle lever. This action draws the container cover toward its base and provides a tight closure. The latch is sold as actuatable from the front only because if mounted in a recess in the container side, it is considered possible to slide one's finger between adjacent containers and actuate the latch without actually seeing more than the end of the lever. Clearly, this suffers the substantial drawback that the latch could not be actuated in this manner if the cover of the container was deep. If it were, the fingers of the user would not reach the latch. Thus, this type of latch is not a viable solution to the front only operation dilemma.

Top mounted latches provide more diversity in the front only operation forum since they truly operate from the exposed surface of the container. Prior art top mounted latches have certain inherent drawbacks with some types of containers (e.g., fluid tight containers). These latches thus leave the art searching for a better solution to the need for front only operation.

One type of top mounting latch is a bail spring latch such as that illustrated in FIG. 2 of the disclosure. This type of latch, although effective in closing and tensioning a container lid, requires a "through the container" mounting. In containers commonly employed for transport of sensitive equipment where a fluid tight seal is required at all times, these latches require a very effective (expensive) dynamic seal. Dynamic seals of this nature are cost prohibitive, subject to failure and therefore do not provide a preferred solution.

Other prior art latches whether top or side mounted which operate well for their intended purpose cannot work where adjacent structures are concerned because of their requirement that they move out of the side plane of the container or where they don't, they simply cannot be easily actuated from the exposed surface of the container. The adjacent structure inhibits the movement and/or access to these latches and prevents operation thereof.

SUMMARY OF THE INVENTION

The above-discussed and other drawbacks and deficiencies of the prior art are overcome or alleviated by the front opening latch of the invention.

Although "front" is employed in this specification as the location of operability of the latch disclosed herein, it will be understood that any plane of the container on which the latch is employed could be the operation plane or surface. More specifically, the latch body could be mounted on the front, top, side, bottom or rear of the container depending upon how the container is being viewed. The more important concept of the invention is that the latch is completely operable from an exposed plane or surface of the container, while acting on an adjacent surface which may be obscured from access or view. This is particularly advantageous when said containers are stacked one atop another or next to one another, etc. The most ubiquitous example of such use is, of course, where many of such containers are stacked in such a way that they create a wall. In this situation, a box in the middle could be opened if the invention is employed but could not have been opened if many of the prior art latches were installed. Since this scenario is most common and the exposed plane of the container is generally considered the "front" by most people, the term "front" has been used herein as the generic descriptor. Limitation is not intended. The invention also has no dynamic seals and is operable using only one hand.

An important feature of the invention is variability in the available stroke for drawdown. By varying the distance between certain components of the invention the stroke is increased or decreased. This benefit is achieved while not affecting the motion of the hook perpendicular to the side of the container. In other words the attachment of the hook to the latch lever, discussed hereunder in detail, does not need to move laterally during drawdown regardless of the stroke of the latch. This concept cannot be achieved by the prior art and provides a significant advantage in function.

Another important feature of the invention is the designed in capability of the latch to be made from plastic materials. The latch is preferably made of thermoplastic polyester which would creep under loads normally associated with latches intended to secure covers to containers as is the current invention. To accommodate the loads in such a way that the desired material is employable, the surface area of load bearing components of the latch have been enlarged to enable sufficient strength of the inexpensive and relatively malleable material to be employed.

The latch of the invention generally comprises a latch body having several components mounted as a unit on one surface of a container and a hook that is disposed generally perpendicularly to the latch body and is selectively engageable with a strike mounted fixedly on a surface of the container adjacent the surface upon which the body is mounted. The latch operates over the generally perpendicular angle by facilitating control of the hook from a spring lever disposed on or in the body.

The latch develops about 100 lbf of closure force near the end of its stroke and securely holds the cover of the container in place and sealed. Operation force required by the user, however, remains very small at 10 lbf or less.

The latch is maintained in the closed position by either or both of an over-center pivot point arrangement relative to the principal drawdown force vector of the draw down assembly and a hold down catch in the latch body.

Another feature of the latch of the invention is a warning system indicating that the latch is not engaged. Since it is desirable to prevent the latch lever from being freely located beyond the outer plane of a container to which it is mounted (i.e., mounted in a recess), it is spring loaded to return to and stay in the down or closed position when it is disengaged. Since in this position the latch appears to be engaged it is advantageous in the preferred embodiment to provide a system to warn a user that the latch is not, in fact, engaged. This is provided by a movement within the body of the latch allowing a colored section to be visible if the latch is not engaged. This colored section is not visible when the latch is engaged.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
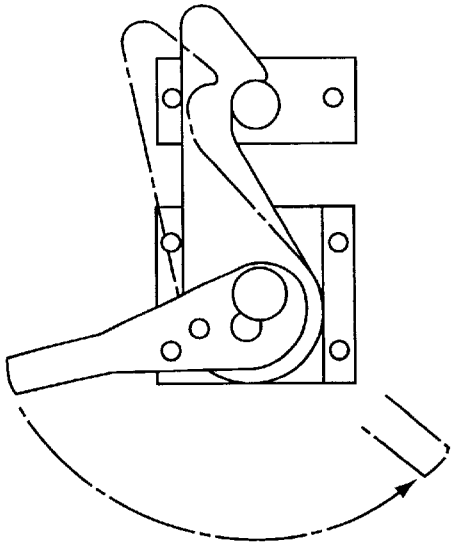
FIG. 1 PRIOR ART
FIG. 1 is an illustration of a prior art latch having some ability to be actuated from the front of a container.
Figure 2:
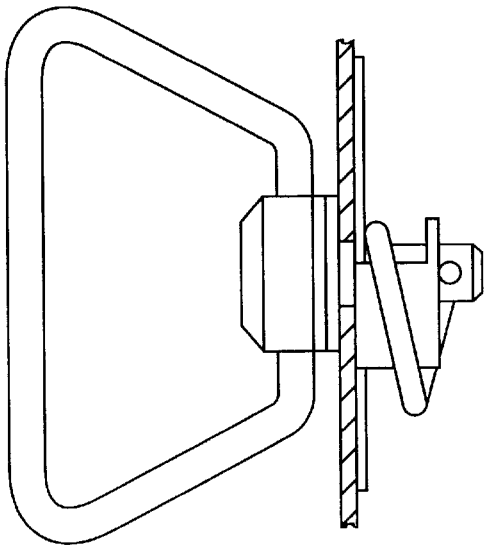
FIG. 2 PRIOR ART
FIG. 2 is an illustration of a second prior art front operated latch where a dynamic seal is necessary for the function of the latch.
Figure 3:
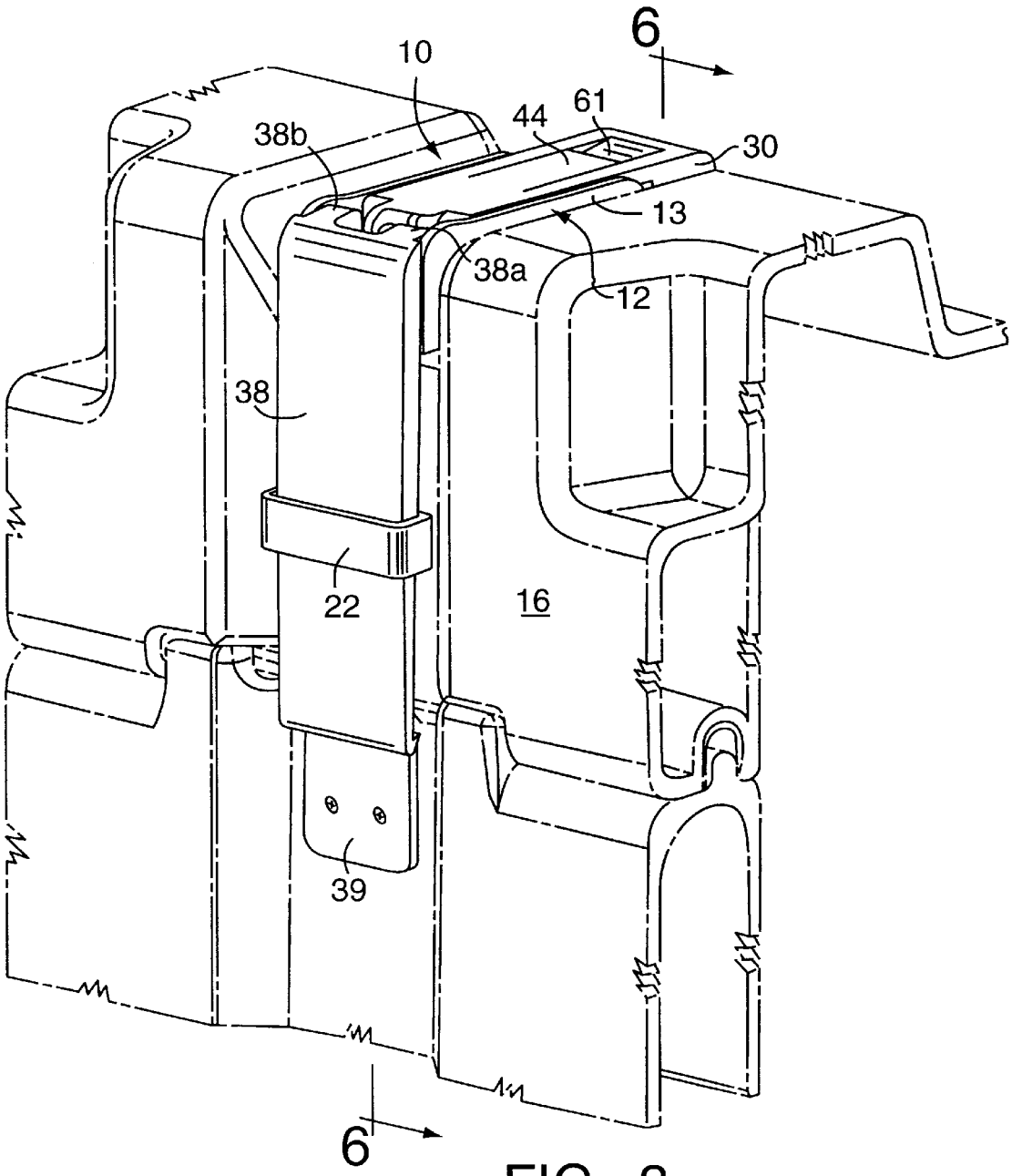
FIG. 3 is a perspective view of a section of a container on which the latch of the invention is mounted in the loaded and secured position.
Figure 6:
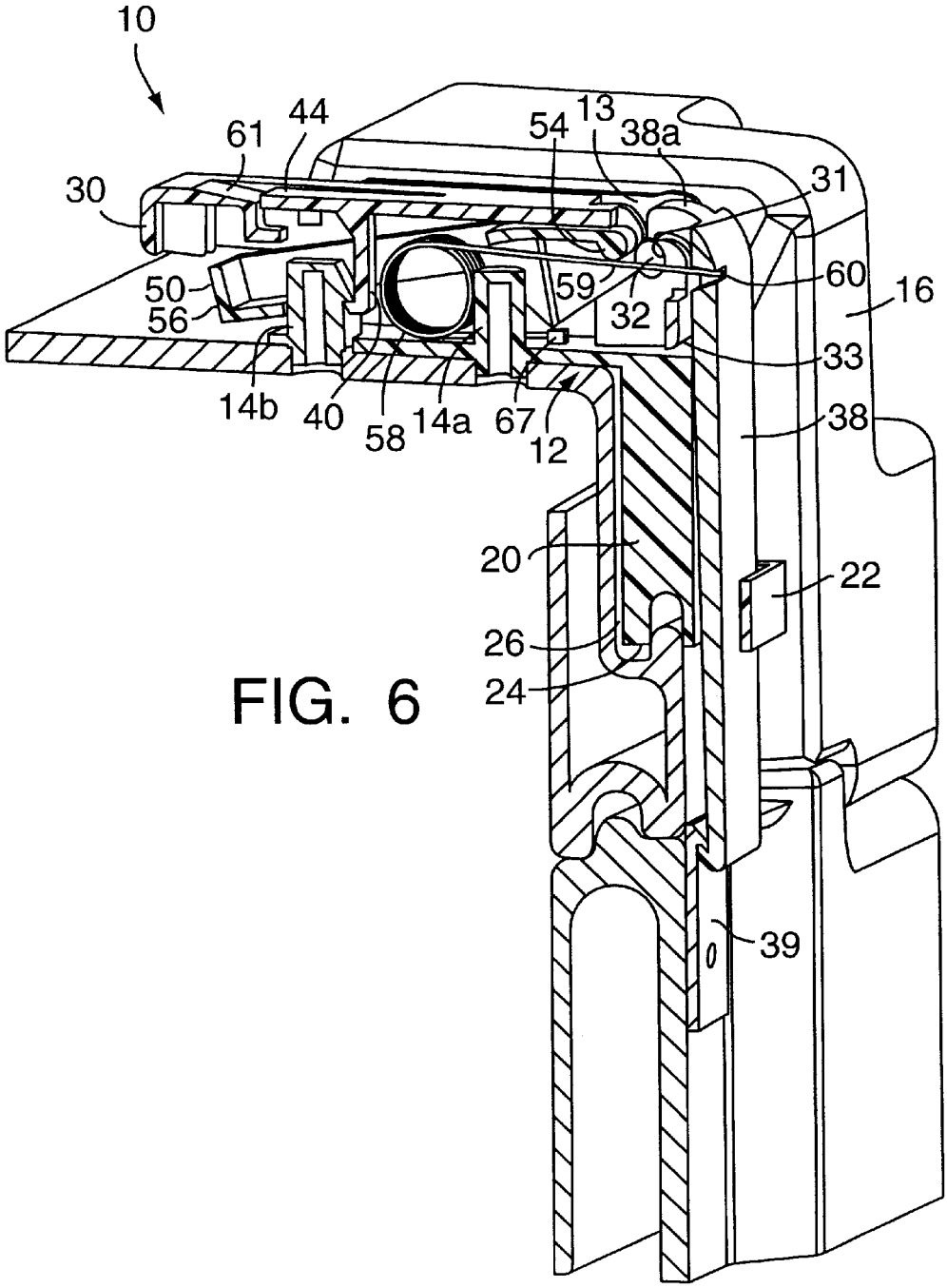
FIG. 6 is a cross-section of FIG. 3 taken along Section Line 6—6.
Figure 7:
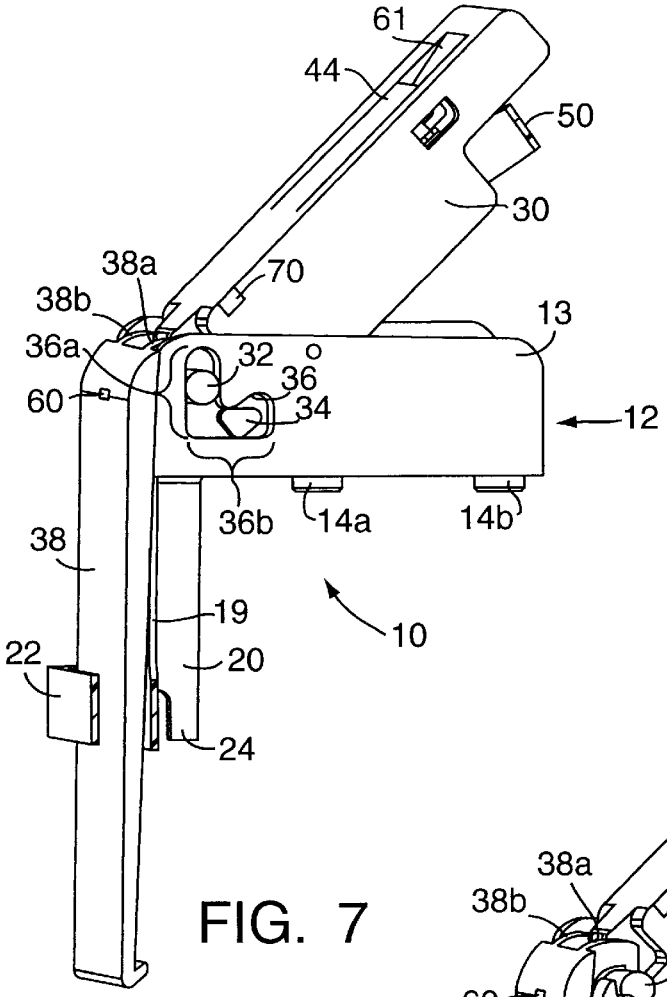
FIG. 7 is a perspective view of the latch of the invention removed from the container and in a partially raised condition to illustrate pin movement within a groove.

Referring to FIGS. 3 and 6, the invention is illustrated in the engaged position. It will be appreciated from a review of these figures that the latch of the invention maintains all components on the exterior of the container to which it is attached, thereby requiring no dynamic seals. This is of great benefit to maintain the fluid tightness often required of the type of container for which the latch was developed. Additionally, this is a significant advance over prior art systems with respect to reliability and economy.

In order to understand the exteriorly visible componentry, reference to FIGS. 7, 8, 9 and 10 should be had. Latch body 10 comprises base 12 with bosses 14*a* and 14*b* for receiving screws from within container 16 to attach latch body 10 thereto. It should also be noted that upon boss 14*b* a catch 18 is located to receive a similar feature on the latch lever discussed hereunder. Catch 18 provides assurance that latch lever 30 stays in the closed position even under the forces (e.g., gravity, impact with other structures, etc.) sustained during the impact of a drop of for example of 10–20 inches by careless personnel or due to perhaps a stack of containers falling over.

Base 12 further includes trap support 19 and trap 22. Trap support 19 is preferably a continuation of base 12 which extends over the edge of the plane upon which base 12 is supported. Trap support 19 functions to provide trap 22 which is desirable in a preferred embodiment to prevent the hook from moving more than necessary to clear the strike and to stay within the recess thereby not breaking the plane of the surface of the container.

In a preferred embodiment trap support 19 further includes an extension 20 perpendicularly oriented thereto. Extension 20 includes a tang 24 which is dimensioned to be received in a depression 26 (see FIG. 6) of the container 16 to provide further restraint for the trap 22. In this preferred embodiment a container must be specifically manufactured to be fitted with this latch. The embodiment is preferred due to the superior strength thereof without the use of additional fasteners. It should be noted, however, that the latch of the invention can be constructed without extension 20 so as to be employable as a retrofit on containers which have not been specifically designed for use with front opening latches of the invention having extension 20.

Referring to FIGS. 3–11 simultaneously, it can be seen that in operable communication with base 12 of latch body 20 is latch lever 30. Preferably, latch lever 30 is nested within uprights 13 of base 12. Lever 30 is required to articulate with base 12 to operate the mechanism of the invention. The articulation of lever 30 with base 12 is through an L-shaped groove 36 in base 12 and a dual pin system. The two pin structures 32 and 34 in communication with the base 12, are designed to move in the L-shaped groove 36 to facilitate the desired movement of the various components of the invention (The terms pin structures are used here because there are actually two parts of each pin, the pin does not extend all the way across the latch.

Hereafter the singular term pin will be employed for simplicity). It is important to note that pin 32 is a part of hook 38 (actually hook 38 splits at its upper extreme to form two hoops 38*a* and *b* to which the pins 32 are attached) and that movement of this pin causes the hook to move through its stroke. Since the desired movement of the hook 38 is substantially parallel to the principal force vector encountered in closing the container on which the latch is mounted, the section 36*a* of L-shaped groove 36 where hook pin 32 moves is also parallel to that principal force vector. Hook pin 32 is mounted in recess 31 of latch lever 30 so that lever 30 may rotate therearound and hook pin 32 transfers draw down force through the lever 30 to the cam surface 33 and then to base 12.

Another important aspect of hook pin 32 is that it is mounted in such a way as to tend to keep the latch lever 30 closed. More specifically, hook pin 32 is mounted in recess 31 in lever 30 in a position allowing it to be just over-center of the cam surface 33 when the latch is in the closed position. This tends to maintain the latch in the closed position.

Figure 8:
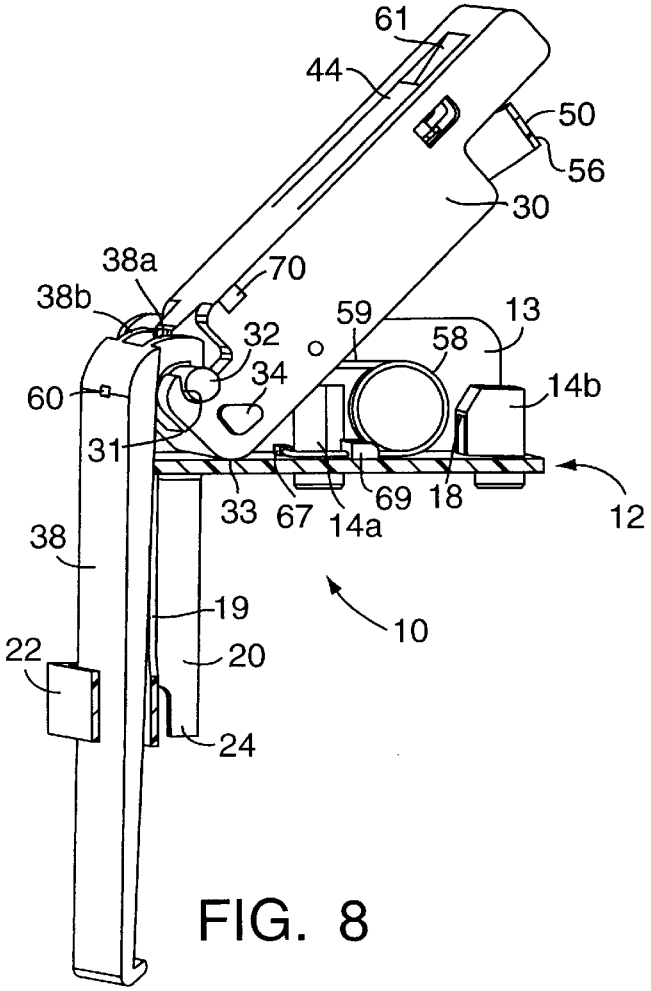
FIG. 8 is the view of FIG. 7 with the closest wall of the base removed to provide a view of the interior of the latch of the invention.
Figure 9:
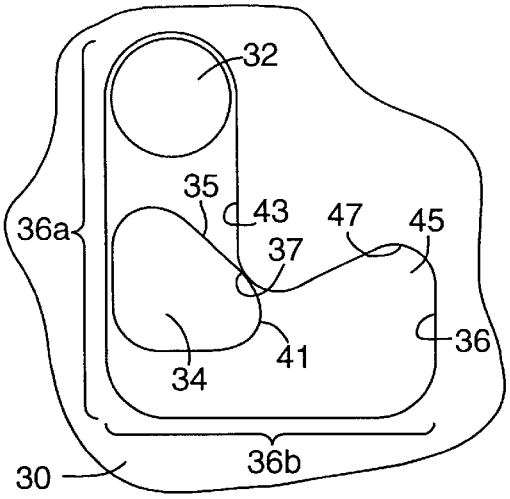
FIG. 9 is an enlarged view of the groove in the latch of the invention.
Figure 10:
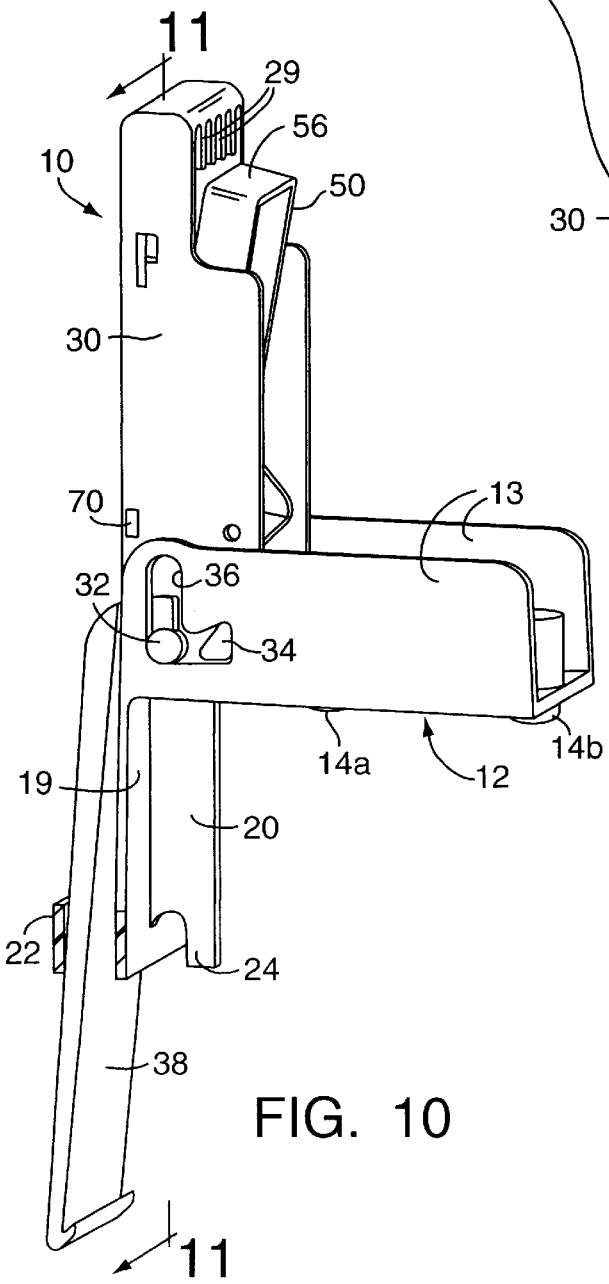
FIG. 10 is a perspective view of the latch of the invention removed from the container wherein the lever of the latch is fully raised and the spring lever released.

Referring specifically to FIGS. 8 and 9, latch pin 34, as will be appreciated by a review of the drawings, has an unusual shape. The shape is important to operation of a preferred embodiment because it provides movement in desired directions only. Importantly, latch pin 34 having a generally triangular appearance facilitates features of the invention such as a latch open flag, positive return of the lever 30 to the closed position and urging of the hook downwardly for engagement or disengagement with the strike. From a review of FIGS. 8 and 9, one of ordinary skill in the art will note that angled surface 35 of latch pin 34, which is preferably about 45° to an imaginary horizontal reference in the drawing, never moves off inside radius 37 of L-shape 36 when the latch lever 30 is in the closed position and the hook is not engaged. This is because if surface 35 were to move off radius 37 in the vertical portion 36*a* of L-shape 36 (i.e., when lever 30 is in the closed and unlatched position) it would not be possible for an operator to lift lever 30 without first pushing and holding the end of lever 30 down against the base 12 to move tip 41 from wall 43 of groove 36. It will be appreciated that if tip 41 is against wall 43, the lever cannot move because the two pins 32 and 34 on each side of lever 30 work against each other in groove 36 to hold the lever 30 in a nearly static state. Providing surface 35 does stay on radius 37, however, when lever 30 is raised, pin 34 merely slides across radius 37 and into the horizontal portion 36*b* of groove 36. The plastic coefficient of friction for a material of choice is preferably at less than about 0.3. The ability to use plastic for the invention is occasioned by the particular construction which spreads the load experienced by the latch over a relatively large surface area.

It should be noted that latch pin 34 is offset relative to hook pin 32 in order to provide a sufficient length of surface 35 to prevent that surface from moving off radius 37. Thus when latch pin 34 is to rotate due to lifting of lever 30, additional space must be provided. If the space of area 45 is not provided, tip 41 would contact the top and bottom walls of groove section 36*b* simultaneously and would prevent lever 30 from being fully raised. Enlarged area 45 is of a shape complimentary to tip 41 of latch pin 34 so that these parts may easily fit into the enlarged area. Because area 45 allows latch pin 34 to rotate 90° in groove 36, lever 30 is rotatable to the fully raised position. Tip 41 bears on radius 47 of area 45 to provide downward leverage to hook pin 32 through lever 30. The hook is therefore urged downwardly toward the end of its stroke when latch pin 34 is in area 45. A benefit is achieved by the arrangement of the latch lever in the base of the invention in that very little actuation force (less than 10 lbf, loaded) relative to the drawdown force (approximately 100 lbf) is needed to open or close the latch when loaded. The use if the preferred plastic material permits the friction coefficient to be maintained below 0.5 with no lubricant.

The latch of the invention substantially avoids perpendicular movement relative to the principal force vector of closure. With respect to the terms "avoids perpendicular movement relative to the principal force vector," it is assumed that firstly that one of ordinary skill in the art will appreciate that there is a principal force vector in a latch mechanism; secondly that the principal force vector existing in the latch of the invention will be along the hook since it is designed to be there and based upon the operation of components, that is where it in fact is; and thirdly that perpendicular movement relative to a vector, includes any movement having a perpendicular component to its movement. This is not to say that the pin 32 necessarily must move in the principal force vector but that it must move in a direction substantially parallel with that vector. The parallel movement may be within the vector but also may be outside the vector.

By moving lever 30 to the raised position the hook pin 32 is allowed (and urged against the bias of spring 58 by continued upward movement of lever 30) to move toward the strike 39 causing the loading force of hook 38 against strike 39 to be released. During re-engagement of the latch of the invention (assisted by the operation of spring lever 50 discussed hereunder), hook pin 32 is moved away from strike 39 with hook 38 catching strike 39. The draw down force created hereby is transmitted to the container cover and compresses a seal (not shown) on the parting line securing the cover to the base of the container. The mechanism of movement of the pin 32 toward strike 39 in the present invention provides the additional benefit of variability in the stroke of the hook 38. By altering the distance between cam surface 33 and hook pin 32 as well as the length of the both portions of L-shape groove 36, the effective stroke of the hook can be varied. The larger the distance between pin 32 and cam surface 33 (and commensurate lengthening of the groove 36), the longer the stroke of the hook. This variability is available while maintaining the hook pin movement to a direction parallel to and proximate to the principal force vector during drawdown. This feature makes the latch of the invention extremely versatile while maintaining the other discussed benefits thereof.

Figure 11:
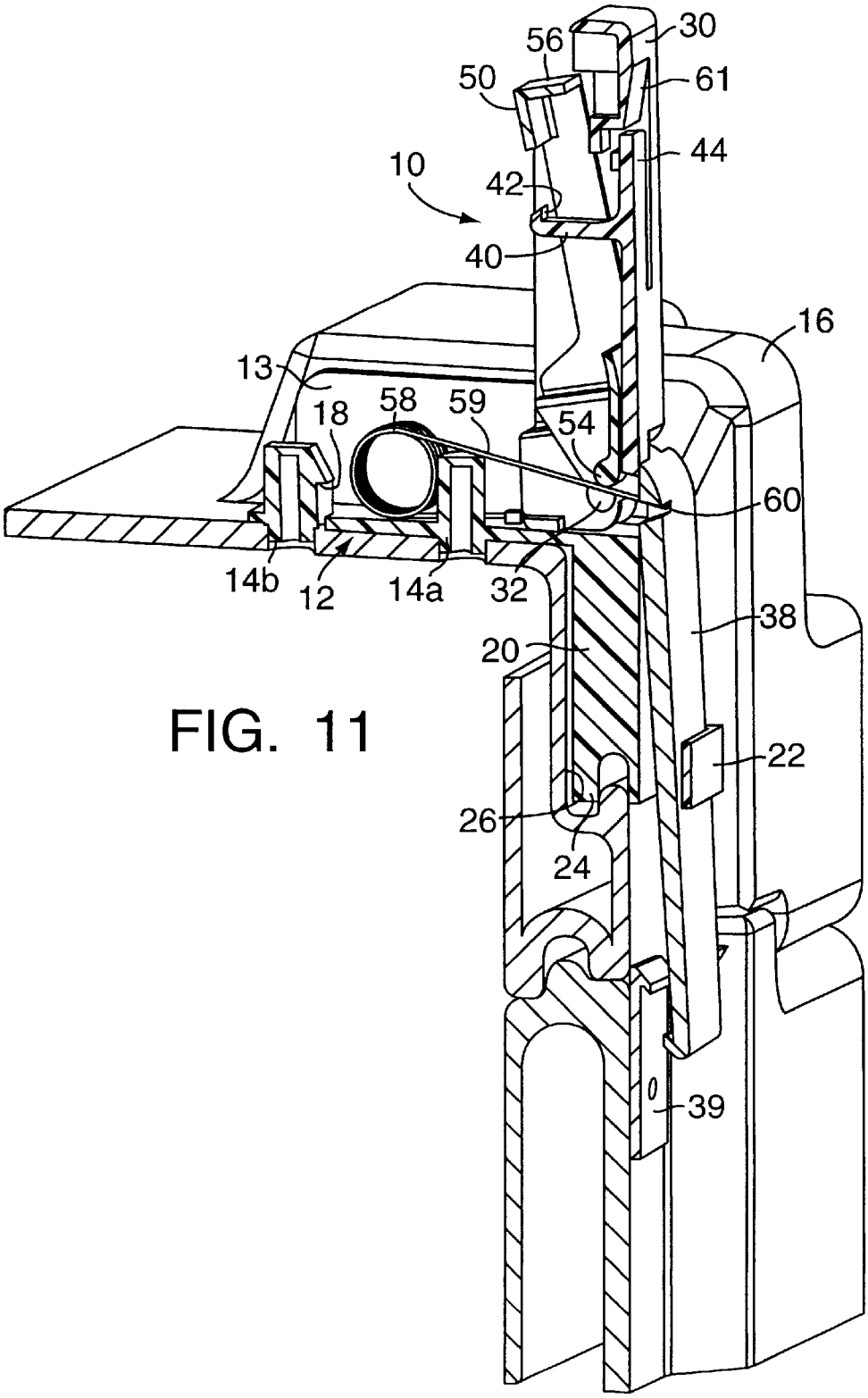
FIG. 11 is a cross-section view of FIG. 10 taken along Section Line 11—11.

In addition to the construction of the over-center pin position, referring to cross-section drawing FIGS. 6 and 11, lever 30 is maintained in the "down" position, redundantly, whether engaged or disengaged, by detent 40 which is preferably a downstruck projection from a center section of the latch lever 30 and positioned to align lip 42 of detent 40 with catch 18 of boss 14*b*. When the latch lever 30 is fully in the down position, lip 42 is engaged with catch 18 and remains in that position until deflected into disengagement by, in a preferred embodiment, button 44 located on the surface of latch lever 30. In a preferred embodiment, button 44 is provided by severing the surface material of latch lever 30 on three sides to create a cantilevered portion that is easily deflected by placing pressure on the end thereof. Deflection ease of button 44 is assisted by chamfer 61 on lever 30 to permit a user's finger more room to deflect button 44.

Figure 5:
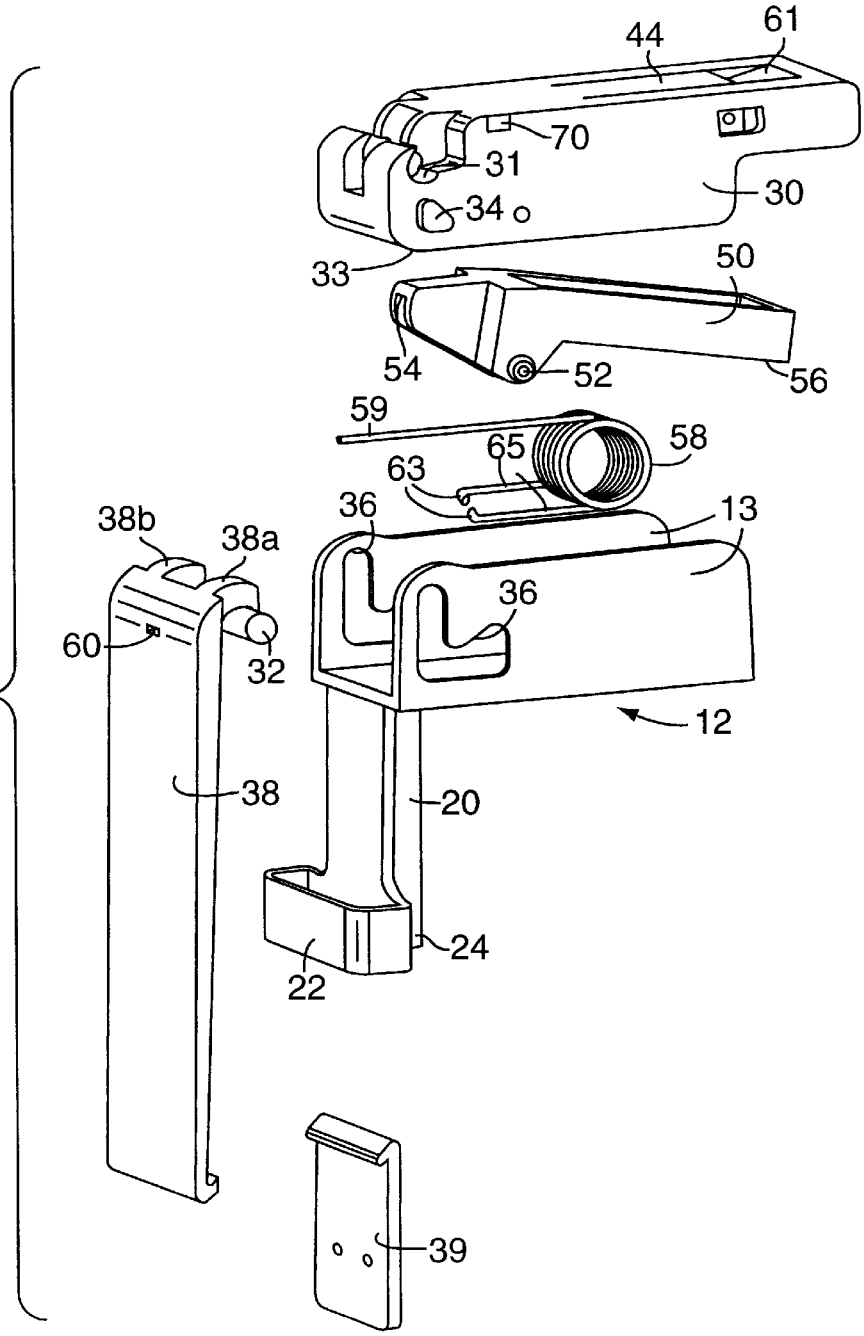
FIG. 5 is an exploded perspective view of the latch of the invention.
Figure 17:
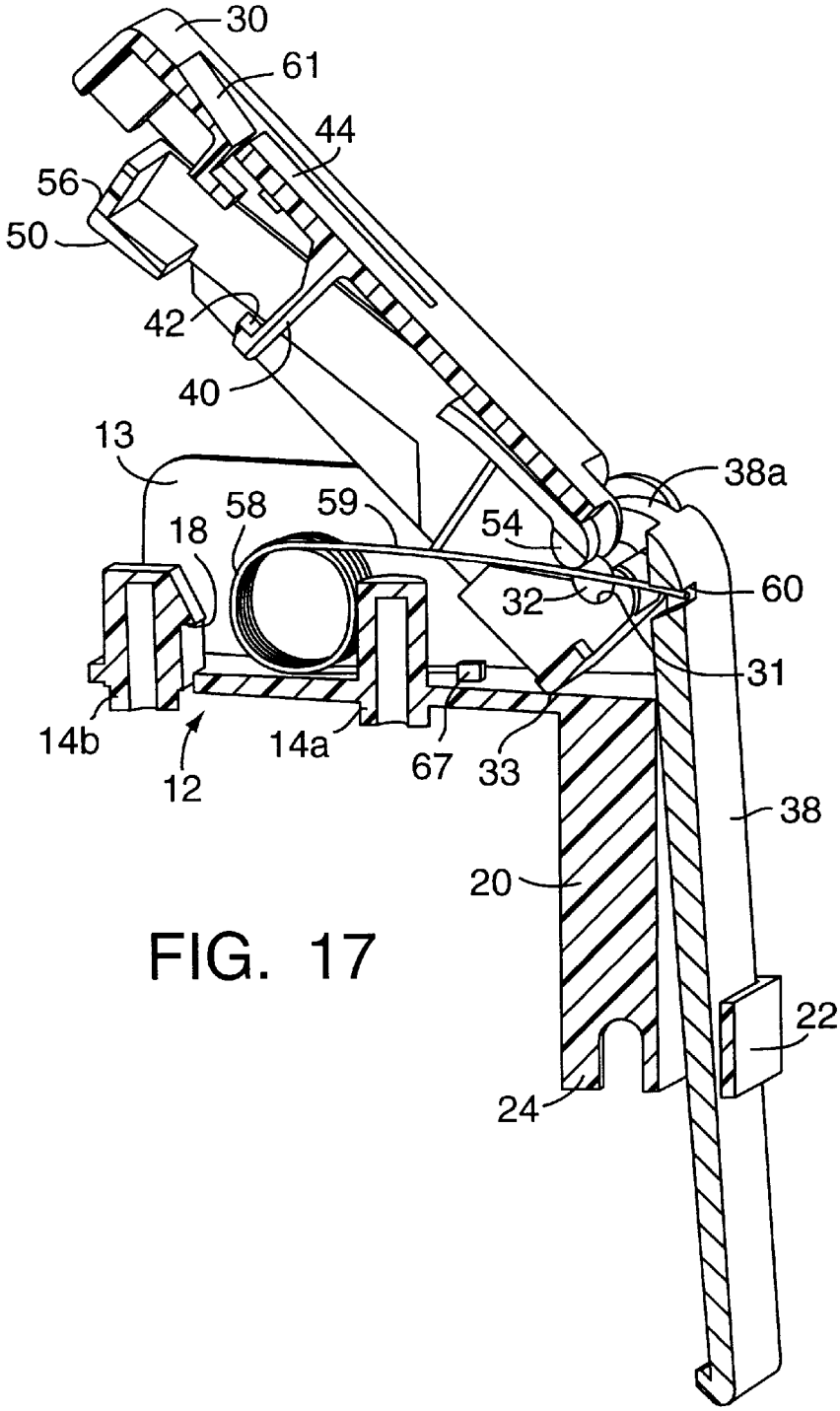
FIG. 17 is a cross-section view of FIG. 7 taken along section line 17—17.

Each of the components of the latch of the invention are assisted in operation by a single spring. Spring 58 is located and secured in base 12 and provides cantilever spring tongue 59 to interact with other components as discussed hereunder. Spring 58 includes feet 63 (see FIGS. 5 and 17) at the ends of legs 65 which are provided to secure the spring. Feet 63 are adapted to fit within blocks 67 while legs are placed under leg holders 69. It will be appreciated that these features are well illustrated on one side of the latch in FIG. 8, however the features are identically provided on the other side of the latch in a preferred embodiment. By employing a single spring for all functions, complexity, cost and assembly time are reduced. To understand operation of spring 58, spring lever 50 must first be introduced. Spring lever 50, best illustrated in FIG. 5, is preferably nested in latch lever 30 and pivotally mounted therein on spring pivot pins 52. The pivot action of lever 50 facilitates one finger deflection of cantilever spring tongue 59 by depressing trigger surface 56. Movement of spring tongue 59 is caused by spring tongue cam 54 bearing thereupon occasioned by actuation of trigger 56 (and by raising latch lever 30). The movement imparted to spring tongue 59 by tongue cam 54, causes it to bear against landing 60 on or in hook 38. (It should be noted that landing 60 can be created by opening a hole in hook 38 (as illustrated) or by providing a projection from the rear surface thereof at an appropriate location to intersect with spring tongue 59. Determining where to place the hole or projection is a matter easily accomplished by one of ordinary skill in the art following exposure to this disclosure and can be viewed representatively in the figures.) Returning to the operation of the invention, by urging spring tongue 59 toward container 16, hook 38 is biased outwardly away from container 16 at roughly 90° to the direction of movement of spring tongue 59 and downwardly. This movement enables the movement of hook 38 with respect to strike 39 to disengage the latch of the invention. Actuating of trigger 56 is necessary to this movement since without actuating trigger 56 the natural bias of spring 58 is away from container 16. The natural bias is useful during a disengagement operation since it provides the impetus needed to misalign hook 38 with strike 39 and facilitate the disengagement of the latch.

During the disengagement operation, when latch lever 30 is opened (moved away from container 16) without actuating the spring lever, the hook 38 is biased upwardly and outwardly by the spring. When the load on the strike is removed, the natural bias of spring 58 moves hook 38 into misalignment with strike 39 and the latch is disengaged. When the lever 30 is released, it is urged down into the closed position by the continued upward urging force of the spring on hook 38.

Reengagement of the latch of the invention is a simple one hand operation. Lever 30 is raised to the upright position and trigger 56 is actuated. These two actions cause hook 38 to be urged into a position where it is aligned with strike 39. Lever 30 is then moved back to the closed position while holding trigger 56 and hook and strike engage and provide draw down force to the cover of container 16. Upon restoring latch lever 30 to the closed position, approximately 100 lbf of draw down force is developed in hook 38 and detent 40 snaps lip 42 into engagement with catch 18 of boss 14*b*.

Figure 4:
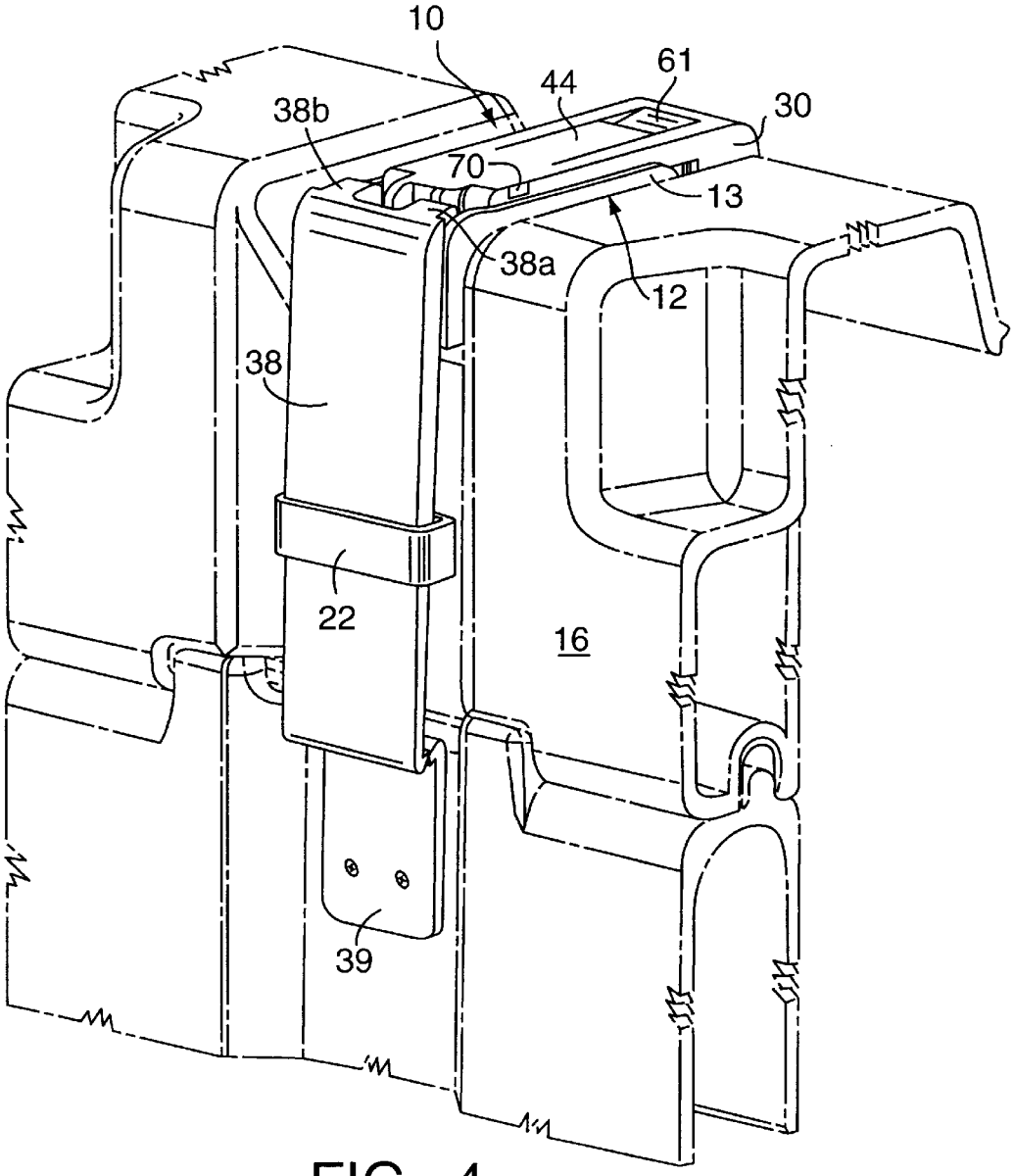
FIG. 4 is a perspective view of a section of a container with the latch of the invention mounted thereon in the unlatched position.

In a preferred embodiment of the invention the exact placement of pin 32, size and shape of pin 34 as discussed and the length of groove 36 is important for a safety feature. Since the latch lever is always biased into the closed position it would be difficult to know if the container was indeed latched shut without checking each of the latches. Visually checking the hook and strike of the latches can be extremely difficult in a wall of containers for the same reasons front operation latches are needed. To alleviate this time consuming, difficult, and often inconclusive procedure, the inventor hereof has devised a warning system as follows and is illustrated in FIG. 4: By allowing room at the top of groove 36, pin 32 is permitted to move high enough to allow latch lever 30 to become slightly unnested in base 12. Pin 34 also moves up groove 36 but as previously stated never moves beyond radius 47. Lever 30 moves upwardly from base 12 approximately $1/8^{th}$ inch by the natural bias of spring 58 when hook 38 is disengaged from strike 39. By providing a brightly colored surface 70 on each side of latch lever 30 that is only visible when the latch lever has been elevated by the $1/8^{th}$ inch due to the hook 38 not being engaged, a quick visual check of the latch will immediately inform the user as to the condition of the latch. When the latch is fully engaged the brightly colored surfaces are completely concealed by upright members 13 of base 12.

An additional and significant benefit of the latch of the invention apart from its fully front only operability is that the forces developed and encountered by the operation of the latch are placed and oriented in such a way that a plastic material such as a thermoplastic polyester, preferably Valox™ can be employed to make these parts. In fact, all parts except the spring 58, hook 38 and strike 39 in the preferred embodiment are constructed of plastic. Spring 58 is preferably constructed of stainless spring steel although other materials could be substituted, as is recognized by one of skill in the art, including plastic. Strike 39 and hook 38 are preferably constructed of aluminum (although again other materials could be substituted which have a yield strength of higher than 40,000 psi).

Figure 12:
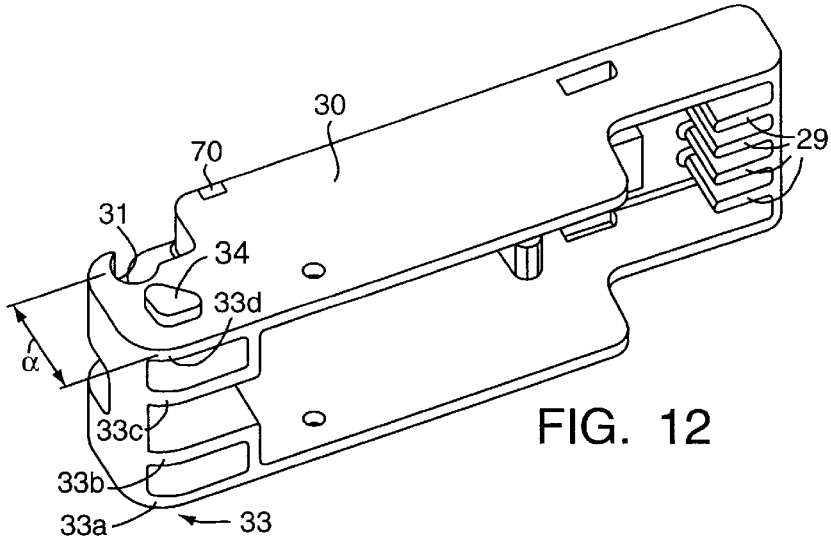
FIG. 12 is a bottom perspective view of the latch lever of the invention.
Figure 15:
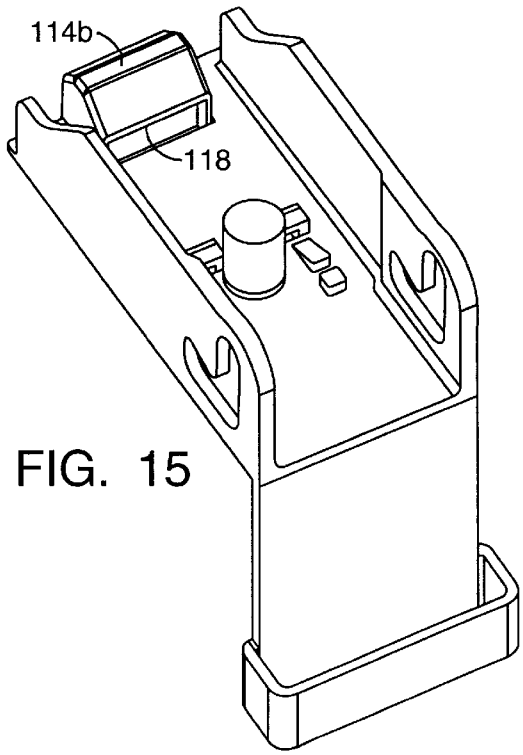
FIG. 15 is a perspective view of the alternate base without other components.
Figure 14:
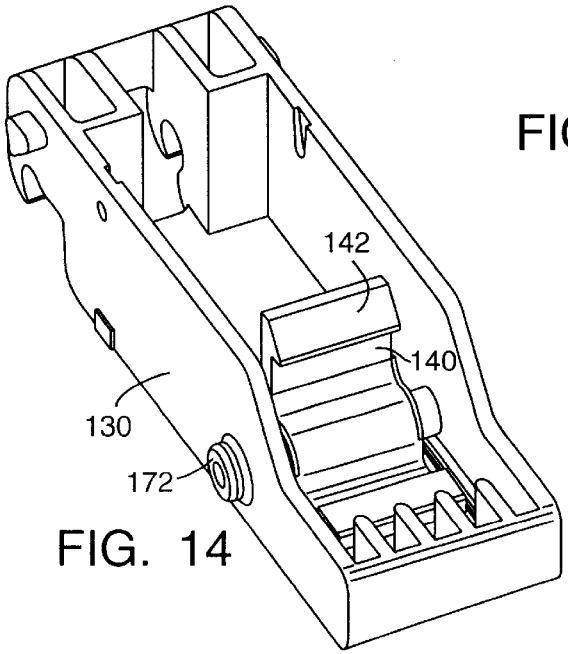
FIG. 14 is a bottom perspective view of the alternate latch lever.

Referring to FIG. 12, lever 30 is illustrated apart from all other parts of the invention and from the bottom to illustrate structure that makes possible the employment of plastic material. As can be appreciated from FIG. 12, cam surface 33 is made up of preferably four force bearing surfaces 33*a–d*. These surfaces distribute the static closure force of the latch. The surface area to be provided is selected so that with a static closure force of 30 lbs, the compressive stress is less than 500 psi and the long term strain at the maximum operating temperature will be less than 2%. The arrangement enables the latch lever cam surface 33 to withstand extended use without significant creep(causing failure or reduction of efficiency). Another area of concentration of forces on a plastic surface is at recess 31. The recesses are each dimensioned to achieve a large surface area to spread the forces experienced. One of ordinary skill in the art having been exposed to this disclosure will recognize that pin 32 of hook 38 is significantly larger than it might be if the latch was constructed of metal. Also visible in FIG. 12 are finger rest protuberances 29 which act both to strengthen the latch lever 30 and to provide comfort to the user.

It will be understood that the latch of the invention can certainly be constructed of material other than plastic (e.g. metal) and may employ surface areas for bearing loads which are below those preferred herein for the use of plastic. This is due to the inherent structural rigidity of metal and should be appreciated by one of skill in this art.

Figure 13:
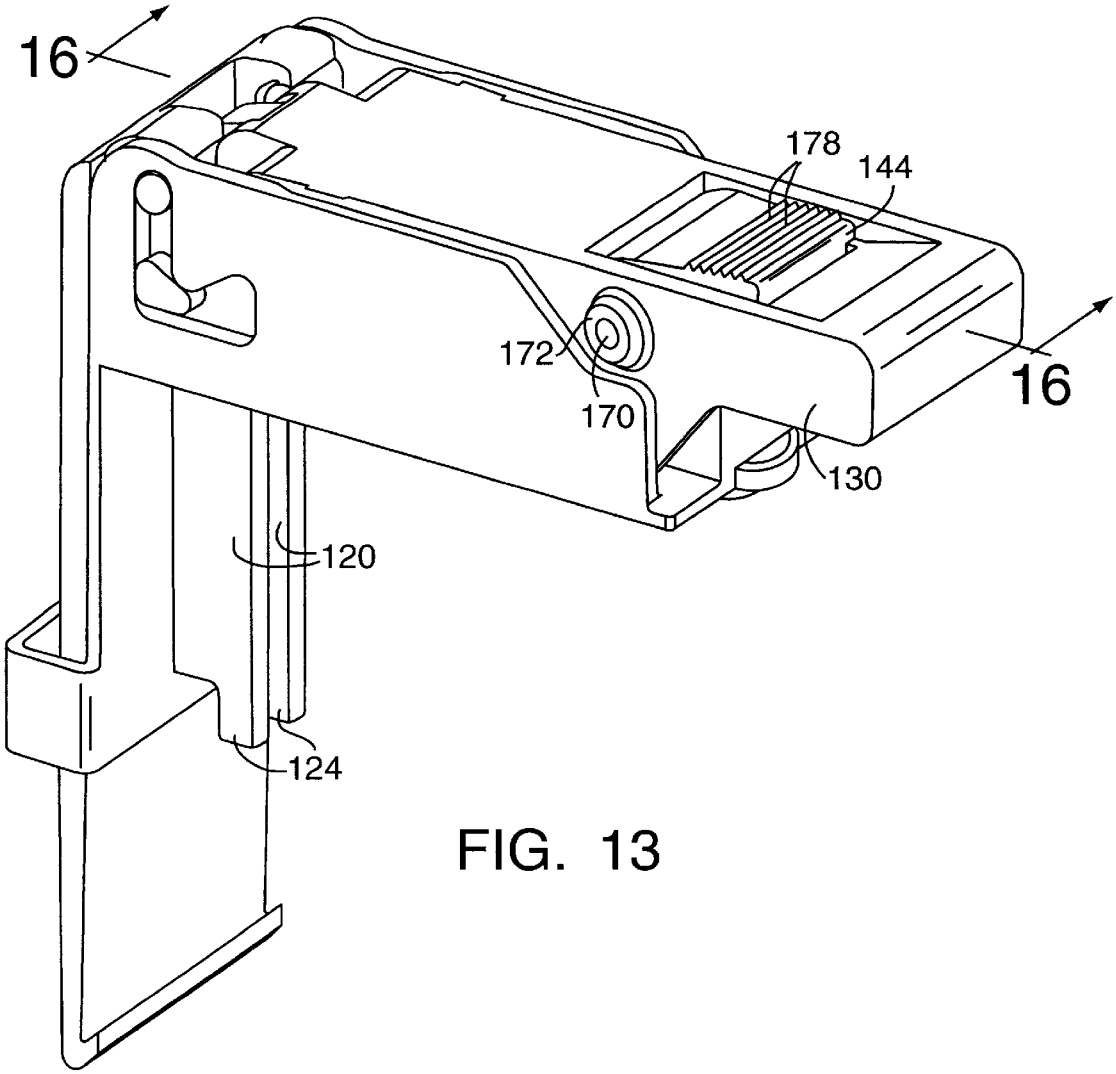
FIG. 13 is a perspective view of an alternate embodiment of the latch.
Figure 16:
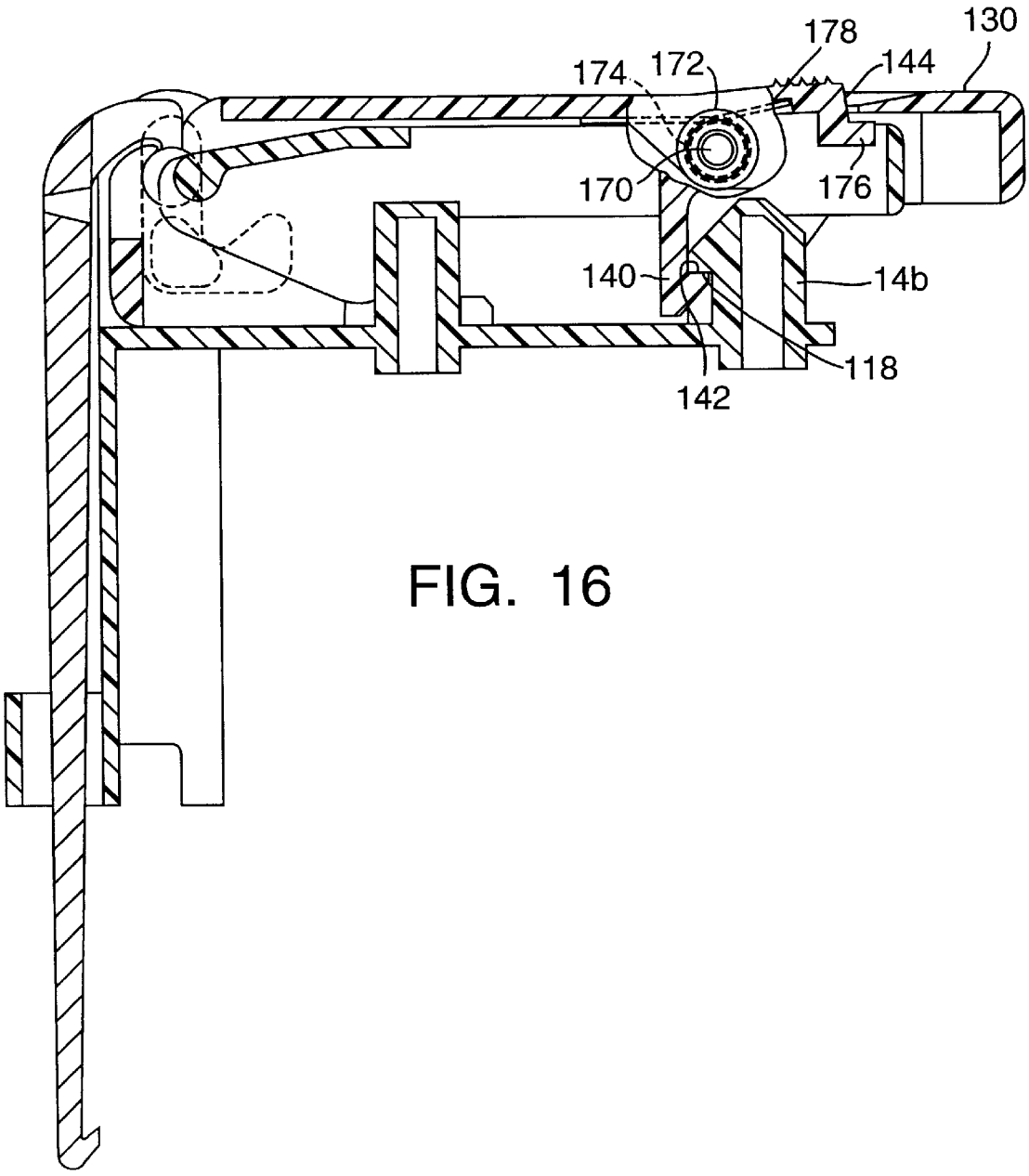
FIG. 16 is a cross-section view of the latch taken along section line 16—16 in FIG. 13.

In an alternate embodiment of the invention, several features are modified. Referring to FIGS. 13–16, button 144 is visible. Button 144 replaces button 44 in the previous embodiment. Button 144 includes downstruck member 140 with lip 142 to engage catch 118 on boss 114*b*. Button 144 is articulated within latch lever 130 on pin 170 in boss 172 on either side of latch lever 130. Button 144 and member 140 are together actuable by depressing button 144 downwardly against spring 174 to disengage lip 142 from catch 118. Button 144 further includes stop 176 to maintain button 144 in the appropriate position when lip 142 is not engaged with catch 118. In a preferred arrangement, button 144 includes ridges 178 for a sure grip. This embodiment is identical in all other respects with the previous embodiment except for the extension and tang of the prior embodiment. In the present embodiment there are two extensions 120 and two tangs 124 as illustrated in FIG. 13. These function in the same way as the prior embodiment.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A single plane operated dual plane latch comprising:

a latch base adapted to be disposed on a first plane;

a hook operably connected to said latch base at an articulation point and adapted to extend along a second plane, said second plane being substantially perpendicular to said first plane;

a strike adapted to be mounted to said second plane and adapted to selectively be engaged by said hook;

a latch lever including a lever pin, said latch lever being adapted to have a securing lip for releasably securing said latch lever to said latch base; and wherein said articulation point includes a hook pin and said latch base includes an L-shaped groove in which said lever pin and said hook pin move, said lever pin is of a generally triangular shape selected to maintain said lever pin in predetermined areas of said L-shaped groove.

2. A daul plane latch as claimed in claim 1 wherein the latch lever includes surface area comprised of a recess in said latch lever adapted to secure said hook pin and a cam surface on said latch lever upon which said latch lever slides is constructed to sustain a compressive force of <500 psi and long term strain of <2% under a static closure force of about 30 lbs.

3. A dual plane latch as claimed in claim 2 wherein said latch lever includes a cam surface and a stroke of said hook is determined by a distance between said cam surface and said articulation point.

4. A dual plane latch as claimed in claim 1 wherein said latch lever is adapted to partially unseat from said latch base when said latch is not loaded.

5. A dual plane latch as claimed in claim 4 wherein said latch lever includes a brightly colored indicator surface that becomes visible when said latch lever is not loaded.

6. A latch comprising:

a base attachable to a first plane;

a latch lever in operable communication with said base;

a spring lever including a deflecting cam in operable communication with said latch lever;

a hook in operable communication with said latch lever and selectively attachable to a second plane, said hook including one of a landing and an opening formed on a distal end thereof;

a strike attachable to said second plane, said strike being selectively engageable by said hook;

a spring mounted to said base and in operable communication with said spring lever and said hook, said spring includes an elongated tongue in operable communication with one of said landing and said opening, said spring is selectively biased by said deflecting cam, thereby urging said hook to disengage from said strike; and wherein said tongue selectivly urges said hook into engagement with said strike when said spring is not biased by said deflecting cam, and said tongue comes into contact with one of said landing and said opening when said spring is biased by said deflecting cam.

7. A latch as claimed in claim 6 wherein said base further comprises at least two L-shaped grooves on either side thereof to provide articulated engagement of said latch lever.

8. A latch as claimed in claim 7 wherein said latch lever includes:

at least one recess for receiving at least one hook pin connected to said hook;

at least one lever pin wherein said at least one hook pin and at least one lever pin are receivable in at least one of said at least two L-shaped grooves, said lever pin having a shape to facilitate desired movement of said latch lever in said at least two grooves.

9. A latch as claimed in claim 6 wherein said latch further comprises:

a detent having a lip connected to said latch lever;

a catch disposed on said base whereby when said detent and said catch are engaged the latch is maintained in a closed position.

10. A latch as claimed in claim 9 wherein:

said spring biases said hook into engagement with said strike when said lip is engaged with said catch; and said spring biases said hook into disengagement with said strike when said lip is disengaged with said catch.

11. A latch as claimed in claim 6 wherein:

said first plane and said second plane are substantially perpendicular to one another.

12. A container latch operable from a single surface comprising:

a latch body having a base, a latch lever articulated in said base, a spring lever articulated in said latch lever and a spring mounted in said base and in operable communication with said spring lever;

a hook having a first catch and a pin, said pin being operably received in said latch lever;

a strike having a second catch complimentary to said first catch whereby when said hook is oriented to catch said strike, a reliable hold down anchor is provided; and wherein said base and said hook are oriented substantially perpendicular to one another.

13. A container latch operable from a single surface as claimed in claim 12 Wherein said base further includes a trap support extending generally perpendicularly to said base, said trap support having a trap disposed thereon, said trap being engaged with said hook.

14. A container latch operable from a single surface as claimed in claim 13 wherein said trap support further includes a tang thereon said tang being receivable in a depression in a container upon which said latch is mounted.

* * * * *